US005444333A

United States Patent [19]

Lau

[11] Patent Number: 5,444,333

[45] Date of Patent: Aug. 22, 1995

[54] ELECTRONIC BALLAST CIRCUIT FOR A FLUORESCENT LIGHT

[75] Inventor: Lake Lau, Walnut, Calif.

[73] Assignee: Lights Of America, Inc., Walnut, Calif.

[21] Appl. No.: 66,564

[22] Filed: May 26, 1993

[51] Int. Cl.[6] ..... H05B 39/00

[52] U.S. Cl. ..... 315/94; 315/102; 315/106; 315/107; 315/DIG. 5

[58] Field of Search ..... 315/94, 95, 96, 102, 315/103, 104, 106, 107, DIG. 5, 289

[56] References Cited

U.S. PATENT DOCUMENTS

| | | | |
|---|---|---|---|
| 4,353,010 | 10/1982 | Knoll et al. | 315/220 |
| 4,415,839 | 11/1983 | Lesea | 315/308 |
| 4,694,224 | 9/1987 | Nakagawa et al. | 315/177 |
| 4,698,554 | 10/1987 | Stupp et al. | 315/307 |
| 4,952,849 | 8/1990 | Fellows | 315/307 |
| 5,027,033 | 6/1991 | Zuchtriegel | 315/106 |
| 5,049,783 | 9/1991 | Kroening | 315/DIG. 5 X |
| 5,049,790 | 9/1991 | Herfurth et al. | 315/291 |
| 5,059,870 | 10/1991 | Choon | 315/106 X |
| 5,111,118 | 5/1992 | Fellows et al. | 315/307 |
| 5,117,158 | 5/1992 | Arbel | 315/220 |
| 5,122,712 | 6/1992 | Hirschmann | 315/106 |

*Primary Examiner*—Robert J. Pascal
*Assistant Examiner*—Haissa Philogene
*Attorney, Agent, or Firm*—Graham & James

[57] ABSTRACT

An energy efficient and cost effective electronic ballast circuit which lights a fluorescent tube but which avoids excessive voltages or pulsing of the tube. The starter circuit preheats the filaments for a time sufficient to ensure quick ignition upon application of an appropriate voltage, then ceases the flow of current after the tube is lighted to avoid wasting energy.

7 Claims, 5 Drawing Sheets

ELECTRONIC BALLAST CIRCUIT FOR A FLUORESCENT LIGHT

FIELD OF THE INVENTION

The present invention is directed to a starter circuit for a gaseous discharge lamp. More particularly, the present invention is directed to an improved starting circuit for starting a fluorescent light.

BACKGROUND OF THE INVENTION

Gaseous discharge lamps, and in particular fluorescent lamps, utilize a ballast circuit for initiating the lighting of a tube. In addition, the ballast circuit controls the distortion effects which can be caused by the such lights on the power supply. Several prior art ballast circuits are known.

A first prior art ballast circuit is termed a "preheat magnetic ballast" circuit which utilizes a magnetic coil in conjunction with a starter circuit for lighting the fluorescent tube. A 60 Hertz (Hz) AC signal is applied across the fluorescent tube, with one side of the circuit having the magnetic coil attached thereto. Current flows through the magnetic coil, through one of the filaments of the fluorescent tube, to a starter circuit. The current warms the filament in the tube while the starter circuit pulses the tube with a voltage in an attempt to initiate fluorescence.

The preheat magnetic ballast circuit has several deficiencies. First, this type of ballast circuit applies 60 Hz AC across the tube to power the light. This is inefficient as compared to using a high frequency AC signal (e.g. more than 10 kHz) used with electronic ballast circuits. When a fluorescent tube is powered with a signal of at least 10 kHz, the output of the fluorescent light will be 15–20% more than if the same tube is supplied with a standard 60 Hz AC signal with the same amount of power consumption.

In addition, the magnetic coil itself is inefficient, resulting in a high energy loss. Further, magnetic coils are bulky in size, heavy and also utilize a lot of raw materials. The voltage which is used by such a ballast circuit to light the tube after preheating is a high voltage. However, excessive voltage across the filaments results in reduced filament life, thereby reducing the life of the fluorescent tube.

High starting voltage causes electrons in the filament material to release from their atoms, causing a sputtering of the filament element. This can result in the familiar darkening at the ends of fluorescent tubes. Eventually, the filament will fail from the excessive voltage. Further, in this type of a ballast circuit, it may be necessary for the starter to pulse the fluorescent tube a number of times with high voltage before the tube lights. This is not only inefficient, but the repeated pulsing causes the filaments to decay more rapidly.

A second ballast circuit is known as a "rapid start ballast" which includes a transformer that constantly supplies the filaments of the fluorescent tube with a current. As such, the filaments of the tube are always maintained in a "warmed-up" condition which enables the lights to be rapidly lighted upon the application of the appropriate voltage. However, once the fluorescent tube is lighted, the transformer continues to supply the filaments with current. Thus, there is always power being supplied across the filaments of the fluorescent tube. Such a condition results in excessive energy waste.

The third type of ballast circuit is known as "instant start." The instant start circuit supplies the tube with an excessively high voltage at start up. Typical starter circuits utilize a voltage which is four to six times the typical operating voltage of the fluorescent tube. The instant start circuit is on the high end of this scale, and it is not uncommon to have a starting voltage as high as 1000 volts AC. While the voltage is high enough to ensure the lighting of the fluorescent tube, the high voltage is harmful to the filaments of the tube as discussed above. Indeed, such high voltage can result in a decrease in the life of the tube by 200% or more as compared to other ballast circuits which do not utilize excessively high voltages to initiate fluorescence.

Thus, there is a need for a ballast circuit having a starter which is energy efficient and which does not cause excessive wear of the filaments of the tube, is inexpensive, and does not have excessive weight.

SUMMARY OF THE INVENTION

The present invention is directed to a ballast circuit for fluorescent lights which includes a starter which is capable of avoiding the problems of the prior art ballast circuits discussed above.

In particular, the present invention is directed to a starter circuit for fluorescent lighting fixtures which is capable of initiating fluorescence in the tube without excessive voltage at start up and without the energy inefficiencies associated with prior art ballast circuits. Further, the ballast circuit incorporating the present invention is light weight, energy efficient, economical to manufacture, and cost effective for the consumer both in direct costs and indirect cost savings. That is, the ballast circuit of the present invention costs less to manufacture, producing savings which can be passed on to the consumer. Further, it promotes a longer life for the fluorescent tubes that are used therewith, thereby requiring the consumer to spend less on fluorescent tubes.

DETAILED DESCRIPTION OF THE INVENTION

Figure 1:
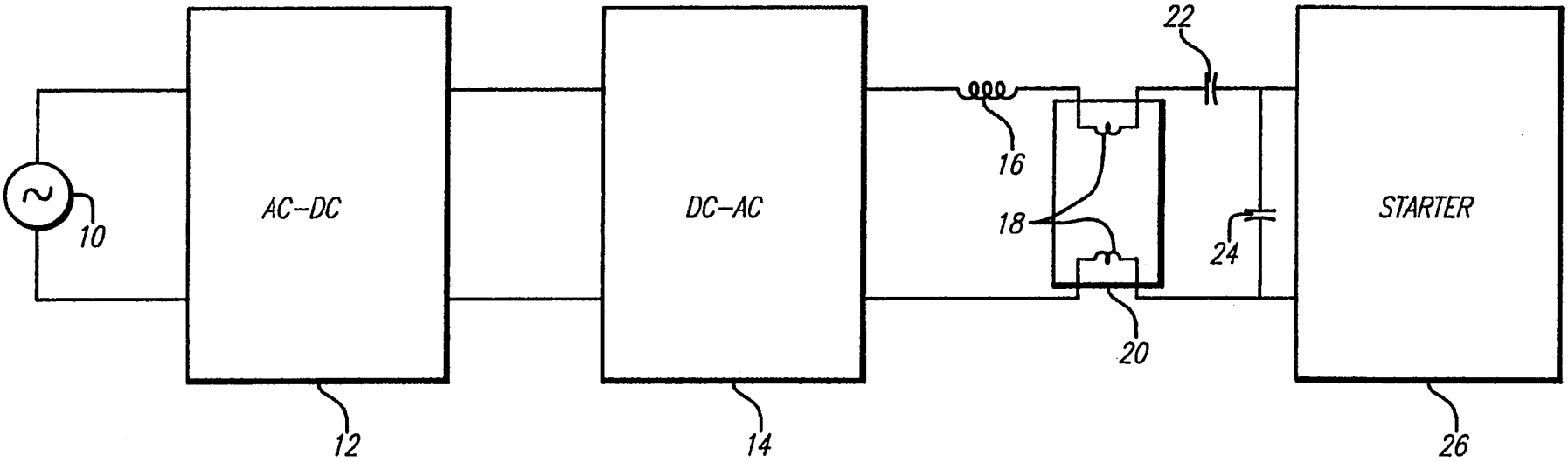
FIG. 1 is a block diagram showing a complete electronic ballast circuit in accordance with one embodiment of the present invention.
Figure 2:
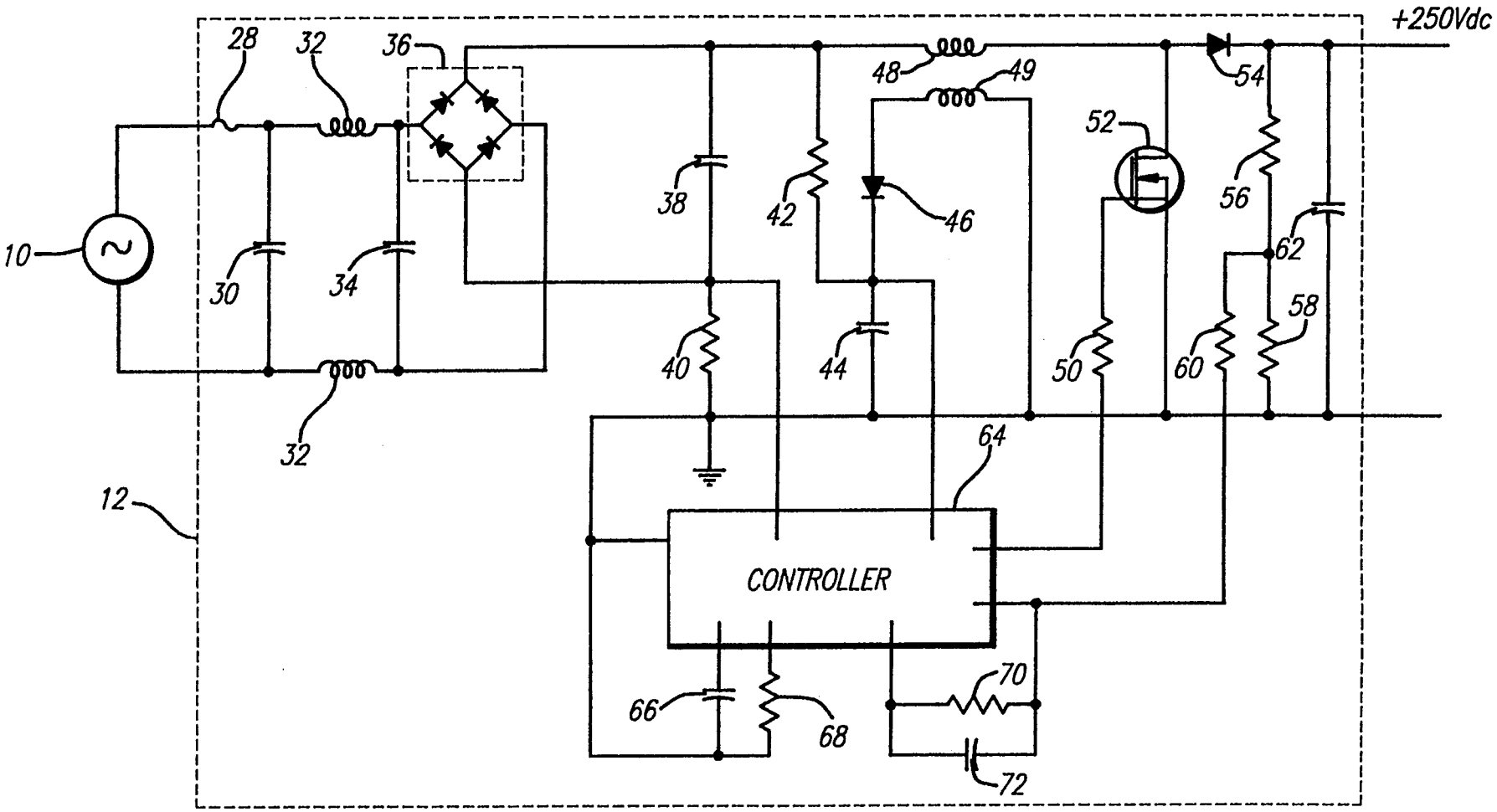
FIG. 2 is a schematic diagram of the AC-DC converter circuit shown in FIG. 1.
Figure 3:
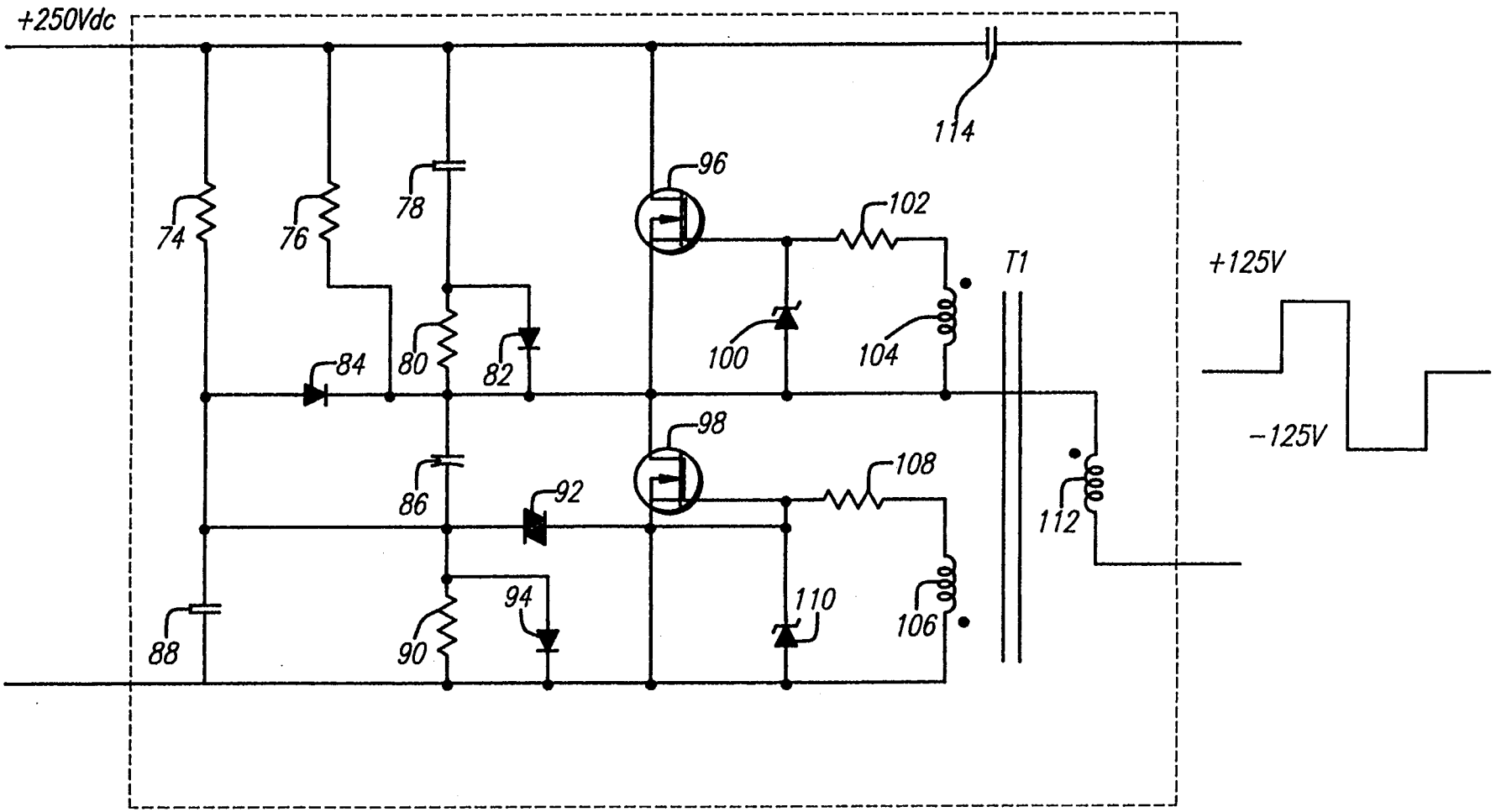
FIG. 3 is a schematic diagram of the DC-AC converter shown in FIG. 1.

Referring to FIGS. 1–3, a 120 volt AC, 60 Hz power supply 10 supplies power to an AC-DC converter circuit 12 which converts the voltage to approximately 250 volts DC on the output. The 250 volt DC output is then supplied to a DC to AC converter circuit 14 (a half bridge inverter) which converts the 250 volt DC input into a 125 volt, high frequency AC square wave output signal which is supplied to a fluorescent light tube 20 through an inductor 16. The 125 volt AC square wave signal is also supplied to a starter circuit 26 through capacitors 22 and 24.

The production of the 125 volt AC high frequency square wave signal can be accomplished using any typical AC to DC and DC to AC converter circuits which are found in most electronic ballast circuits. The square wave signal has a frequency between 20 and 30 kHz, but ideally is 25 kHz.

When the circuit is first powered up, power supply 10 supplies 120 volts AC at 60 Hz through protection fuse 28 and an input filter including capacitors 30, 34 and inductors 32. The input filter protects the circuit against line transients and attenuates any EMI (electromagnetic interference) perturbations generated by the high-frequency power supplied to the tube 20. The diode bridge 36 rectifies the line voltage and to produce a DC voltage and current then begins to flow through resistor 42 to charge capacitor 44. Capacitor 38 controls the percentage of allowable input current ripple. Resistor 40 serves as a zero current detector for controller 64 to prevent an over-current condition in the ballast circuit.

At start-up, resistor 42 and capacitor 44 provide for the supply of power to controller 64. The increasing voltage across capacitor 44 depends upon the time constant produced by the resistor 42 and the capacitor 44. After approximately 1.5 seconds, diode 46 serves to rectify the AC signal from the secondary winding 49 to supply capacitor 44 with a charging current. Thus, after the initial period of approximately 1.5 seconds, diode 46 and capacitor 44 become the power supply for controller 64. Inductor 48 serves to boost the power supplied from the diode bridge 36. Resistor 50 limits the peak current from the controller 64 which is used to switch transistor 52.

Transistor 52, which is controlled by controller 64, charges the inductor 48 in accordance with the instantaneous value of the rectified supply voltage, thus ensuring that the power supply 10 provides sinusoidal line current and voltage which are in phase. Transistor 52 also regulates the voltage across storage capacitor 62, thereby making the AC-DC unit 12 largely independent of the load voltage and supply voltage. This voltage regulation arrangement results in constant lamp power even in the event of power supply voltage fluctuations.

Diode 54 is connected on the output side of the inductor arrangement 48 and rectifies the boosted voltage supplied therefrom. This boosted voltage is then supplied to a voltage divider circuit formed by resistors 56, 58, and 60, which serve to regulate the voltage across output capacitor 62. Capacitor 66 and resistor 68 form an RC circuit for setting the switch-on time of controller 64. Resistor 70 and capacitor 72 serve as a ripple rejection circuit for eliminating the 120 Hz ripple associated with the voltage across capacitor 62. Lack of an adequate ripple rejection circuit may cause distortions in the input current from power supply 10.

The connection of the circuit elements shown in FIG. 2 serve several important functions. While, it may be possible to simply place capacitor 62 across the output of the diode bridge 36 and eliminate the circuit elements in between, in doing so, the voltage and current would no longer be phase regulated. This would result in large harmonic distortions which would adversely effect the power factor of the power supply system.

Further, as discussed above, transistor 52 and the voltage divider circuit formed by resistors 56, 58, and 60 regulate the voltage across output capacitor 62, ensuring that the system does not respond to power line fluctuations which could have a great effect on the supply of power to the fluorescent tube 20 if the elements between the capacitor 62 and diode bridge 36 were removed.

From the initial moment when the AC power source 10 is turned on, it takes approximately 1.5 seconds to reach a threshold voltage of the controller 64. The controller 64, which may be any suitable power factor controller or regulator such as models UC1852, UC2852, or UC3852 manufactured by Unitrode Integrated Electronics of Merrimack, N.H., boosts the output voltage across the capacitor 62. During the first 1.5 seconds, when the controller 64 is not activated, the un-boosted voltage across the capacitor 62 powers the half bridge inverter 14.

Resistor 74, capacitor 88, together with the diac 92 form a sawtooth wave generator which is required for starting the half bridge inverter 14. It may be possible to replace the diac 92 with a silicon bi-lateral switch (SBS). Because of the feedback produced by the current transformer T1, high frequency self-resonance sets in. Diode 84 shuts down the sawtooth wave generator after the self-resonance sets in. The resonant circuit includes inductor 16 and capacitor 22. This produces enough current passing through capacitor 22 and the starter 26 to warm the filaments but does not produce enough voltage across the fluorescent tube 20 to ignite fluorescence in the tube.

Resistor 76 biases the transistor 98, holding it in a high voltage state. Resistor 80, diode 82 and capacitor 78 form a snubber circuit for power transistor 96, while resistor 90, diode 94 and capacitor 86 for a snubber circuit for power transistor 98. The snubber circuits serve to absorb spikes produced during the switching of power transistors 96, 98. Power transistors 96, 98 are switched in sequence to convert the 250 volt DC supplied from the AC to DC converter 12 into a 125 volt AC square wave signal. Resistors 102,108 limit the current flowing into the gate of the power transistors 96, 98, respectively.

The zener diodes 100, 110 operate to clamp the voltage produced by the feedback current generated from transformer T1 and help set the desired operating frequency of the inverter. Transformer T1 serves as a current transformer whereby load current flowing through the primary 112 will produce the gate drive voltages through secondaries 104, 106 for power transistors 96, 98. This causes the circuit to oscillate, producing the high frequency square wave provided to the lamp. The capacitor 114 serves to remove the DC portions of the lamp voltage and current output from the DC-AC circuit 14.

After approximately 1.5 seconds of operation, controller 64 begins to operate and clamps the intermediate circuit voltage at capacitor 62 at approximately 250 volts. The half bridge inverter 14 is then powered by the boosted voltage supplied from the inductor circuit 48. Current continues to preheat the filaments until the filaments have just reached their emission temperature. The emission temperature is the temperature at which the filaments begin to break down. At this point, the starter switch is opened to change the resonant frequency. The overall capacitance of capacitors 22 and 24 contributes to the resonant circuit in order to produce a voltage spike which is sufficient to cause the tube 20 to ignite.

In a preferred embodiment of the present invention, this spike is approximately 260 volts, but is not limited to such voltage. With a normal tube operating voltage of approximately 110 volts, this represents approximately 2.3 to 2.4 times the normal operating voltage of the tube. In practice, such voltage spike may range from as low as two to as high as three times the operating voltage of the tube. This is much less than typical prior art ballast circuits which utilize a typical starting voltage of four to six times the operating voltage of the tube.

After the tube 20 ignites, the voltage across the lamp automatically breaks down to the operating voltage of the tube 20. Current does not pass through the starter circuit, although there is current circulating through the filaments under normal operating conditions. However, this is the normal operating current which must circulate through the filaments and is not additional "warming current" as was present in the prior art. Accordingly, the lamps have increased efficiency.

Figure 4:
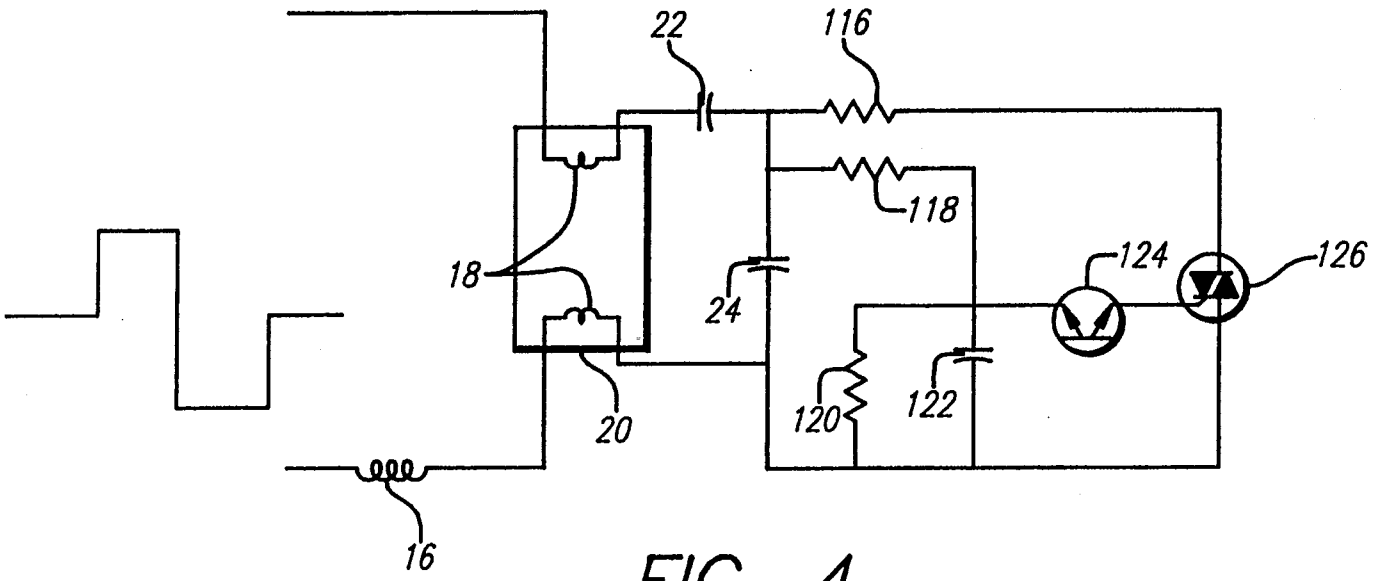
FIG. 4 is a schematic diagram of the starter circuit shown in FIG. 1.

Referring to FIG. 4, the square wave high frequency AC signal supplied from the half bridge inverter 14 is changed to a high frequency sinusoidal wave signal due to the resonance circuit formed by inductor 16 and capacitors 22, 24. Inductor 16 also serves as a current limiter, limiting the amount of current which reaches the tube 20. Capacitor 22 supplies the filaments 18 with the warming current and capacitor 24 determines the starting voltage to be applied to tube 20. The high frequency sinusoidal then passes through filament 18, capacitor 22, thermistor 116, triac 126 and back through the second filament 18.

Thermistor 116 is a positive temperature coefficient (PTC) thermistor which, at low temperatures, has a very low resistance (approximately $55\Omega \pm 20$ percent) which increases as the temperature thereof increases. Accordingly, over time, as current flows through the thermistor 116, the temperature increases and the resistance increases, causing a corresponding decrease in the amount of current passing therethrough.

Figure 5:
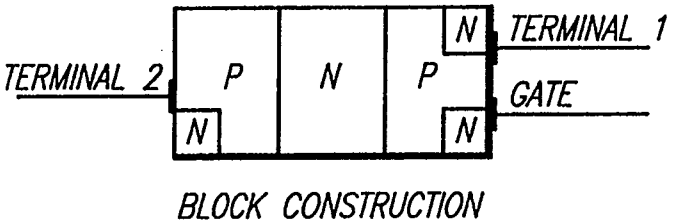
FIG. 5 is a detailed diagram of an element shown in the starter circuit of FIG. 4.

Triac 126, which is shown in more detail in FIG. 5, is a high performance PNPN device which can be initially switched on by a high instantaneous voltage (dv/dt) applied across terminals 1 and 2. When voltage is suddenly impressed across a PN junction, a charging current will flow which is equal to $i=C(dv/dt)$ where C is the capacitance formed across each PN junction. When C(dv/dt) becomes greater or equal to the triac gate current, the triac switches on and essentially appears as a short.

As a result, current first flows through the capacitor 22, the thermistor 116 and the triac 126. There is no current passing through capacitor 24 because the thermistor 116 is initially at a very low starting temperature and thus has a very low resistance. It takes approximately one or two seconds for the thermistor to increase in temperature such that it moves into a high resistance state (this assumes a 500 to 700 milliamp RMS current).

Once the triac 126 is switched on, a holding current (or minimum principal current required to maintain the triac in the on-state) must be maintained or triac 126 automatically stops conducting and appears as an open circuit. When the thermistor 116 becomes highly resistive, this causes a corresponding decrease in the current passing through both the thermistor and the triac 126. When the current passing through the triac 126 drops below approximately 25 milliamps (a typical holding current), the triac stops conducting (i.e., moves to an "open state"). When triac 126 stops conducting, capacitors 22 and 24 are essentially in series but in parallel with the tube 20.

The operation of the switching circuit is as follows. At power up, current passes through element 18, capacitor 22, thermistor 116 and triac 126, and back through the second filament 18 of tube 20. Thus, the filaments 18 heat up. The PTC thermistor 116 and the triac 126 set the time that the filaments achieve emission temperature (i.e. are sufficiently warm).

That is, the thermistor 116 and triac 126 are preferably selected so as to provide a warming period sufficient to ensure that filaments 18 are warmed just to the point that the emission temperature of the filaments is achieved. Thus, thermistor 116 can be selected to have a predetermined temperature coefficient curve and the triac can be selected to have a holding current sufficient to ensure that the triac does not transition from the closed or conducting state to the open or non-conducting state until the filaments 18 achieve a sufficiently warmed condition.

As the current travels through thermistor 116, the temperature increases, and thus the resistance increases. As the resistance increases, the current passing through thermistor 116 and triac 126 decreases. When the current flowing through the triac decreases below the holding current of the triac 126, the triac 126 ceases conducting.

When triac 126 opens, the capacitor 22 and the capacitor 24 are electrically in series. Thus, the combined capacitance thereof decreases since the total capacitance is the multiplication of capacitance 22 by capacitance 24 divided by the sum thereof. The decrease in capacitance produces a resulting voltage increase across the fluorescent tube which is temporary, but which is sufficient to initiate fluorescence in the tube 20.

Thus, the fluorescent tube is lighted, and, with triac 126 open, there is no longer any current flowing through the switching circuit to warm the filaments 18. Under normal operating conditions, there is a small cathode current which circulates through the filaments, but this is required for the operation thereof. The capacitor 22 which controls the preheating current is approximately 0.022 $\mu$F to 0.033 $\mu$F. The capacitor 24 which sets the starting voltage and the circulating current through the filaments is approximately 0.01 $\mu$F.

After the tube 20 lights, the ordinary operating lamp voltage will appear across capacitors 22 and 24 which are in parallel with the tube 20. A filter circuit and voltage divider, which is formed of resistors 118, 120, capacitor 122 prevents the voltage reaching diac 124 from increasing above than the breakdown voltage of the diac 124. Diac 124, which can be a 32 volt bi-directional diac, prevents the triac 126 from receiving a gate pulse. As a result, there is no chance that triac 126 will receive a gate signal after the tube 20 lights which will trigger the triac 126 to a conducting state, and only the above-discussed cathode current will circulate through the filaments 18. Thus, no power will be wasted as is the case with the prior art starting circuits.

Figure 6:
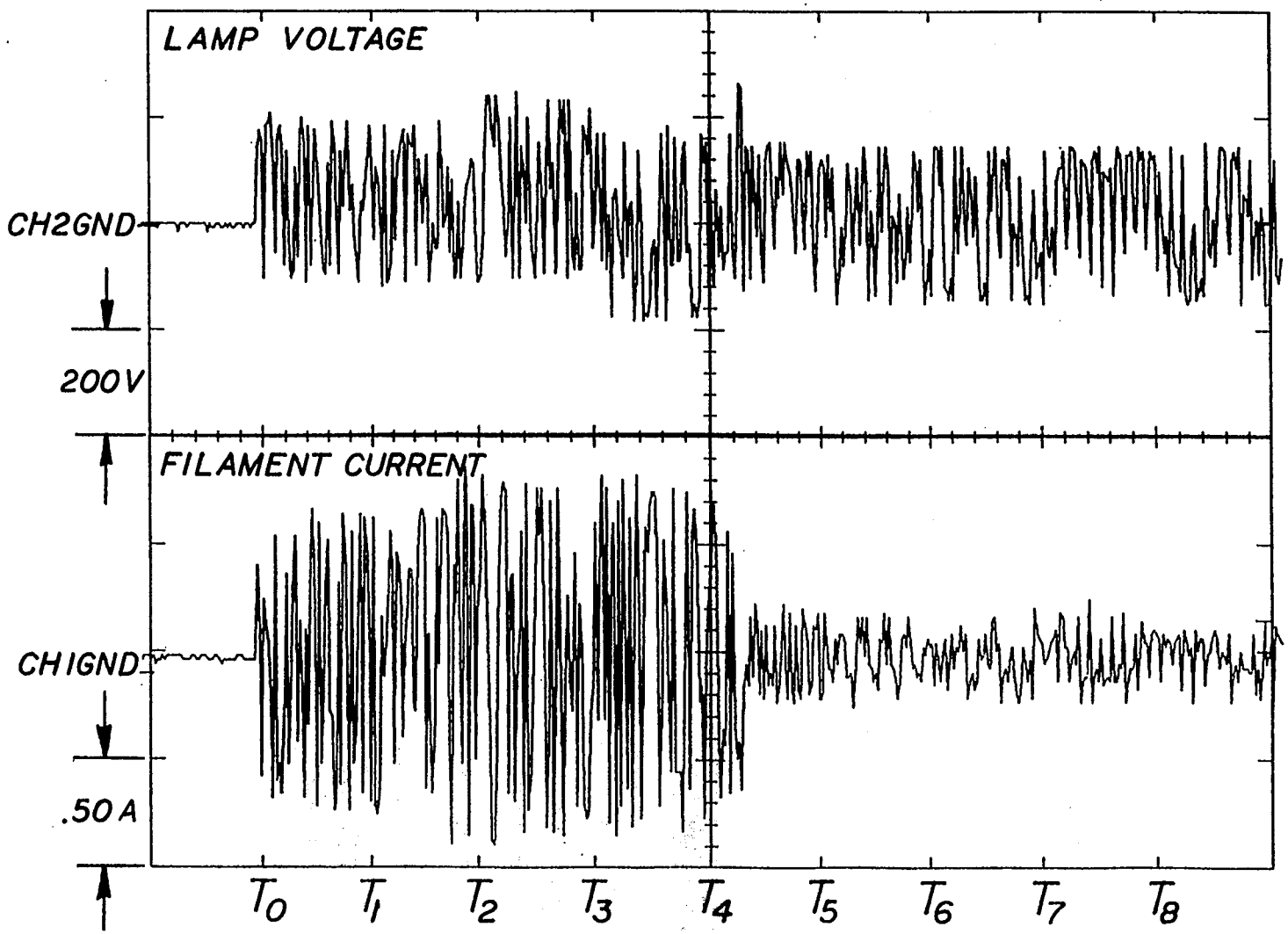
FIG. 6 is a graphical representation of the voltage and current relationship in a fluorescent light tube showing before and after ignition voltage and current in accordance with the present invention.

Looking at the graph of the filament current in FIG. 6, it is seen that initially the filament current is negligible. At time $T_0$, the power-on sequence is initiated and the filament current increases in order to warm up the filaments. The heating of the filaments continues until approximately a time $T_4$, when the thermistor temperature has increased to the point that the current passing therethrough falls below the holding current of the triac 126.

At this point, the triac 126 switches open and there is a corresponding simultaneous spike in the lamp voltage up to approximately 260 volts which can be seen just to the right of time period $T_4$ in the graph showing the lamp voltage. This spike in the lamp voltage is caused by the effective decrease in the capacitance resulting from the introduction of the capacitance of capacitor 24 in combination with capacitor 22 in response to the opening of the triac 126. The voltage spike is sufficient to light the lamp due to the warmed condition of the filament.

As can be seen in FIG. 6, after the lamp is lighted at approximately time $T_4$, the filament current reduces to the normal operating current (i.e. cathode current) of the filament 18. Similarly, the voltage of the lamp is reduced and maintained at a normal operating level of approximately 110 volts (note that FIG. 6 shows the peak-to-peak voltage as opposed to RMS values). The operating voltage of the lamp can change depending on the type of fluorescent lamp being used. The current through the starter circuit is eliminated due to the opening of the triac 126, and no energy is wasted from unnecessary circulation of excess current through the filaments 18 once the lamp is lighted.

Thus, as described above, the present invention provides a starter circuit for a fluorescent light which reduces energy consumption by eliminating the flow of current in the starter circuit after the fluorescent tube is lighted. Further, the filaments do not continuously receive a supply of current for preheating purposes, but rather receive a supply of current only for a short time period immediately preceding the lighting of the fluorescent tube which is sufficient to warm the filaments to the emission temperature.

Thus, a lower starting voltage can be used to light the tube. Since a lower starting voltage is used, the filaments last longer since they are not subjected to the severe high starting voltages of the prior art which cause the filaments to wear down more quickly. Further, the present invention utilizes lightweight components as opposed to the heavy magnetic circuits found in the prior art, thus the ballast circuit incorporating the present invention is lighter in weight than the prior art.

The above described embodiments of the present invention are not to be considered in a limiting sense. Rather, the above description is merely illustrative of a preferred manner for carrying out the present invention. However, one skilled in the art would readily appreciate that the described embodiments could be modified without departing from the spirit and scope of the present invention which is best defined by the claims which appear below.

I claim:

1. An electronic ballast circuit for a fluorescent light comprising:

circuit means for converting power from low frequency alternating current to high frequency alternating current to apply across a fluorescent light tube including at least one filament;

starter means responsive to the high frequency alternating current for preheating the at least one filament for a first time period and for eliminating current through the starter means after the first time period, wherein the starter means includes switch means having an open state and a closed state, the switch means being responsive to an initial supply of high frequency alternating current from the circuit means to automatically switch from the open state to the closed state, wherein the starter means preheats the at least one filament by circulating current through the switch means and the at least one filament when the switch means is in the closed state, the switch means further including current reducing means for reducing the current through the switch means over time and wherein the switch means automatically switches from the closed state to the open state when the current reducing means reduces the current through the switch means to a predetermined level; and switch protection means for preventing the switch means from switching from the open state to the closed state after the switch means has automatically switched from the closed state to the open state.

2. The electronic ballast circuit according to claim 1, further including pulse means for providing the fluorescent light tube with an electrical pulse after the first time period.

3. The electronic ballast circuit according to claim 2, wherein the fluorescent light tube has a normal operating voltage, and the electrical pulse has a voltage in a range from two times the normal operating voltage to three times the normal operating voltage.

4. The electronic ballast circuit according to claim 3, wherein the electrical pulse has a voltage approximately 2.4 times the normal operating voltage of the fluorescent light tube.

5. The electronic ballast circuit according to claim 1, wherein the current reducing means reduces the current to the predetermined level over a second time period equal to the first time period.

6. The electronic ballast circuit according to claim 1, wherein the switch means comprises a triac.

7. An electronic ballast circuit for a fluorescent light comprising:

power supply means for converting low frequency alternating current to high frequency alternating current and supplying the high frequency alternating current to a fluorescent light tube, the fluorescent tube having a pair of filaments; and starter means responsive to the high frequency alternating current for providing a preheating current to the pair of filaments for a first time period and for supplying a starting voltage to the fluorescent light tube after the first time period, the starter means eliminating the flow of preheating current through the pair of filaments after the first time period, wherein the power supply means includes distortion control means for removing harmonic distortions produced when the low frequency alternating current is converted to high frequency alternating current, and regulator means for regulating the high frequency alternating current supplied to the fluorescent light tube, the regulator means being responsive to fluctuations in the low frequency alternating current such that the high frequency alternating current supplied to the fluorescent light tube is substantially constant.

* * * * *